US008181824B2

(12) United States Patent
Ziesel et al.

(10) Patent No.: US 8,181,824 B2
(45) Date of Patent: May 22, 2012

(54) SYSTEMS AND METHODS FOR PREDILUTION OF SWEETENER

(75) Inventors: Lawrence B. Ziesel, Woodstock, GA (US); Gregg Carpenter, Marietta, GA (US); Robert Hughes, Atlanta, GA (US); Daniel S. Quartarone, Stone Mountain, GA (US)

(73) Assignee: The Coca-Cola Company, Atlanta, GA (US)

( * ) Notice: Subject to any disclaimer, the term of this patent is extended or adjusted under 35 U.S.C. 154(b) by 842 days.

(21) Appl. No.: 12/251,469

(22) Filed: Oct. 15, 2008

(65) Prior Publication Data

US 2010/0089948 A1 Apr. 15, 2010

(51) Int. Cl.
*B67D 7/74* (2010.01)

(52) U.S. Cl. ..... 222/129.4; 222/1; 222/129.1; 222/132; 222/145.5; 222/146.6; 222/148

(58) Field of Classification Search ..... 222/129.2, 222/148, 129.3, 1, 129.4, 135, 145.5, 145.6, 222/144.5, 145.1, 146.6, 129.1, 132
See application file for complete search history.

(56) References Cited

U.S. PATENT DOCUMENTS

| | | | | |
|---|---|---|---|---|
| 859 | A | 12/1990 | Augustine | |
| 5,975,365 | A * | 11/1999 | Hsieh | 222/129.4 |
| 6,350,484 | B1 | 2/2002 | Ault | |
| 6,660,314 | B2 | 12/2003 | De Martinville et al. | |
| 6,915,926 | B2 * | 7/2005 | Naik | 222/146.6 |
| 7,293,675 | B1 * | 11/2007 | Luhn | 222/148 |
| 7,383,966 | B2 | 6/2008 | Ziesel | |
| 7,828,175 | B2 * | 11/2010 | Bethuy et al. | 222/129.1 |
| 7,905,373 | B2 * | 3/2011 | Beavis et al. | 222/1 |
| 7,913,879 | B2 * | 3/2011 | Carpenter et al. | 222/129.4 |
| 2006/0003053 | A1 | 1/2006 | Ekanayake | |
| 2006/0191964 | A1 | 8/2006 | Ziesel | |
| 2007/0205219 | A1 | 9/2007 | Ziesel | |
| 2007/0205220 | A1 * | 9/2007 | Rudick et al. | 222/129.4 |
| 2007/0267441 | A1 | 11/2007 | van Opstal | |
| 2010/0224649 | A1 | 9/2010 | Hoover | |

FOREIGN PATENT DOCUMENTS

WO WO 9637120 A1 * 11/1996

OTHER PUBLICATIONS

U.S. Appl. No. 11/782,833, filed Jul. 25, 2007, Ziesel.

* cited by examiner

*Primary Examiner* — Frederick C. Nicolas
(74) *Attorney, Agent, or Firm* — Sutherland Asbill & Brennan, LLP

(57) ABSTRACT

A beverage dispensing system using a sweetener. The beverage dispensing system may include a dispensing nozzle, a sweetener source with the sweetener at more than about 65° brix, a first diluent source with a first diluent, a mixing chamber in communication with the sweetener source and the first diluent source so as to dilute the sweetener to less than about 65° brix, and a second diluent source with a second diluent so as to dilute further the sweetener upstream of the dispensing nozzle.

18 Claims, 4 Drawing Sheets

SYSTEMS AND METHODS FOR PREDILUTION OF SWEETENER

TECHNICAL FIELD

The present application relates generally to beverage dispensers and more particularly relates to methods and systems for the dilution and the predilution of sweeteners and other fluids used in beverage dispensers and other types of dispensing systems.

BACKGROUND OF THE INVENTION

Beverage dispensers traditionally mix syrups and/or other types of concentrates with a diluent such as water or carbonated water to produce a beverage. The syrups or other types of concentrates may include a mixture of a sweetener, such as high fructose corn syrup ("HFCS"), sucrose (sugar), or other types of materials, with flavorings, colors, or other ingredients. Alternatively, the sweetener and the other ingredients may be separated and pumped individually to a dispensing nozzle or other type of dispensing means.

In order to provide as many beverage options as possible, the flavoring, the coloring, and the other additives may be condensed into micro-ingredients, i.e., concentrations of about ten to one (10:1) or higher. The beverage dispenser then combines these micro-ingredients with various types of macro-ingredients, such as the sweeteners, and with diluents to form a beverage. This type of separation is described in commonly owned U.S. Patent Publication No. 2007/0205221 entitled "Beverage Dispenser System", filed on Mar. 6, 2006. This application is incorporated herein in full by reference.

In addition to the use of the concentrated micro-ingredients, it also may be desirable to concentrate the sweetener. For example, native HFCS is available at about 77° brix. (Degrees Brix is a measurement of the mass ratio of the dissolved sweetener to water.) Such a concentration is advantageous to use in that it is generally shelf stable. Currently available pumps, however, may not be able to pump reliably such a highly viscous fluid. Diluting the HFCS to a pumpable state, however, may compromise or limit the shelf life of the HFCS, require the use of refrigeration, and/or require the use of a clean-in-place system or other type of sanitization system and procedures. Diluting the HFCS or other type of sweetener also provides good mixing.

There is a desire, therefore, for systems and methods for providing HFCS, sucrose, and other types of sweeteners in a beverage dispensing system in a concentrated and substantially shelf stable form. Such systems and methods should apply to the use of any type of sweetener.

SUMMARY OF THE INVENTION

The present application thus may provide a beverage dispensing system using a sweetener. The beverage dispensing system may include a dispensing nozzle, a sweetener source with the sweetener at more than about 65° brix, a first diluent source with a first diluent, a mixing chamber in communication with the sweetener source and the first diluent source so as to dilute the sweetener to less than about 65° brix, and a second diluent source with a second diluent so as to dilute further the sweetener upstream of the dispensing nozzle.

The sweetener may include high fructose corn syrup, sucrose, an acid component, a preservative, and/or a pasteurized sweetener. The beverage dispensing system further may include one or more first pumps. The first pumps may include a metered pump or a positive displacement pump. One or more further pumps also may be positioned downstream of the first pumps. The further pumps may be positioned downstream or upstream of the mixing chamber.

The beverage dispensing system further may include a cooling circuit. The cooling circuit may be positioned downstream or upstream of the mixing chamber. The beverage dispensing system also may include a clean-in-place system in communication with the mixing chamber and the dispensing nozzle. A further mixing chamber also may be used.

The present application further describes a method of providing a sweetener to a dispensing nozzle. The method may include storing the sweetener at a brix of about 65° or higher, flowing the sweetener to a mixing chamber, diluting the sweetener to a brix of less than about 65°, flowing the sweetener to the dispensing nozzle, and further diluting the sweetener upstream of the nozzle.

The storing step may include storing the sweetener remote from the dispensing nozzle. The step of flowing the sweetener to a mixing chamber may include pumping the sweetener with one or more pumps. The method further may include the step of chilling the sweetener. Chilling the sweetener may include chilling the sweetener before or after diluting the sweetener. The method also may include cleaning in place the mixing chamber and the dispensing nozzle.

The present application further provides for a beverage dispensing system using a sweetener. The beverage dispensing system may include a dispensing nozzle, a sweetener source with the sweetener at more than about 65° brix, a pump in communication with the sweetener source, a first diluent source with a first diluent, a mixing chamber in communication with the sweetener source and the first diluent source to dilute the sweetener to less than about 65° brix, a chilling circuit to chill the sweetener, the first diluent, or both, and a second diluent source with a second diluent so as to further dilute the sweetener at the dispensing nozzle.

These and other features of the present application will become apparent to one of ordinary skill in the art upon review of the following detailed description when taken in conjunction with the several drawings and the appended claims.

DETAILED DESCRIPTION

Figure 1:
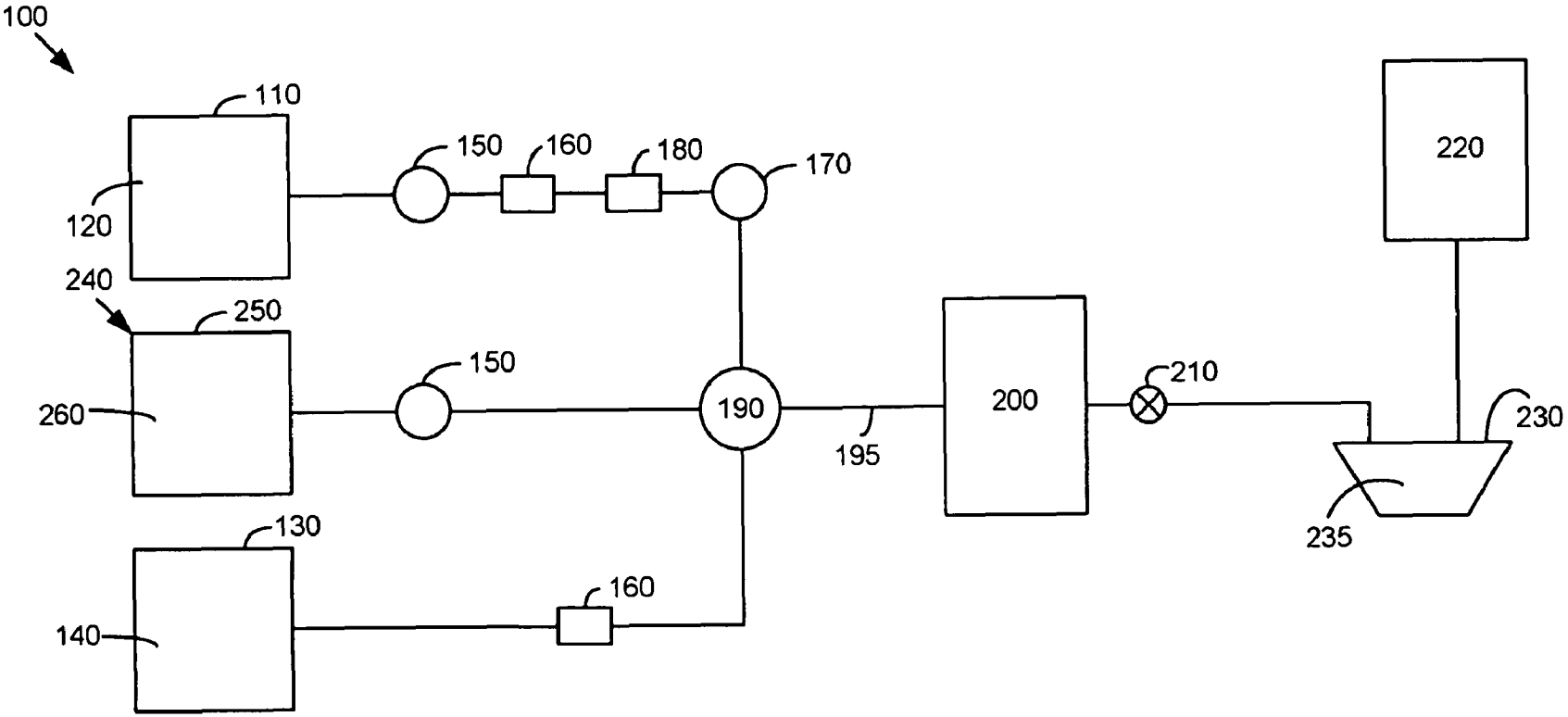
FIG. 1 is a schematic view of a beverage dispensing system as is described herein.

Referring now to the drawings, in which like numerals refer to like elements throughout the several views, FIG. 1 shows a beverage dispensing system 100 as is described herein. The beverage dispensing system 100 may include one or more sweetener sources 110. The sweetener sources 110 may include a tank, a bag-in-box, a figal (five gallon), or any other type of container or containers. The sweetener sources 110 may include a sweetener 120 therein. As described above, the sweetener 120 may include HFCS, sucrose (sugar), or any similar type of material. In this first example, the sweetener 110 may include HFCS.

The beverage dispensing system 100 also may include one or more diluent sources 130. The diluent sources 130 may include any type of conventional water supply. A tank or a container similar to those described also may be used. The diluent sources 130 may include a diluent 140 therein. The diluent 140 may include water, carbonated water, and the like. Other types of diluents also may be used herein.

The beverage dispensing system 100 further may include any number of first pumps 150. The first pumps 150 may include conventional bag-in-box pumps or other types of metered pumps, positive displacement pumps, including reciprocating, metering, and rotary pumps, and/or other types of fluid moving devices. One or more separate metering devices 160 also may be used. One of the first pumps 150 may be in communication with the sweetener source 110. The diluent source 130 also may be in communication with one of the first pumps 150. Alternatively, the diluent source 130 may have sufficient pressure so as to flow the diluent 140 without the use of the first pump 150 or other type of pumping device.

The beverage dispensing system 100 also may include one or more further pumps 170. The further pumps 170 may be similar to the first pumps 150 described above or otherwise. Any number of the further pumps 170 may be used. The number of pumps 170 may depend on the location of the sweetener sources 110 and the distance that the sweetener 120 must travel and/or the nature and concentration of the sweetener 120. A sweetener source 110 adjacent to the dispenser may not need the further pumps 170 while a sweetener source 110 in the back room or otherwise remote may need one or more. The positioning of the further pumps 170 may vary.

One or more vacuum regulators 180 also may be used. The vacuum regulators 180 may be positioned upstream of the further pumps 170 or otherwise. The vacuum regulators 180 may be of conventional design and generally may be used with a bag-in-box source. The vacuum regulators 180 maintain a substantially constant vacuum at the inlet thereof. Similar types of regulator devices may be used herein.

The beverage dispensing system 100 further may include a mixing chamber 190. The mixing chamber 190 may be in communication with the sweetener sources 110 and the diluent source 130. The mixing chamber 190 may be of conventional design and size. The mixing chamber 190 may one of the first pumps 150 or another type of pumping device. Likewise, the mixing chamber 190 may be T connection in one of the lines. The mixing chamber 190 mixes and dilutes the sweetener 120 with the diluent 140 to form a diluted mixture 195. The amount of the dilution may vary. The positioning of the mixing chamber 190 may vary. More than one mixing chamber 190 may be used.

The beverage dispensing system 100 also may include one or more cooling circuits 200. The cooling circuit 200 may have any number of pathways therein so as to cool the diluted mixture 195, the sweetener 120, the diluent 140, and/or other fluids therein. The cooling circuit 200 may be of conventional design and may include a cold plate or similar types of cooling devices. The cooling circuit 200 may not be needed for certain types of beverages that may be served at room temperature or above such as teas and the like. As is shown below, the cooling circuit 200 may be positioned in several different locations within the beverage dispensing system 100.

The beverage dispensing system 100 further may include one or more shutoff valves 210. The shutoff valve 210 may be of conventional design. Similar types of devices may be used herein. The positioning of the shutoff valves 210 may vary herein.

The beverage dispensing system 100 may include one or more nozzle diluent sources 220. The nozzle diluent source 220 may be similar to the diluent sources 130 described above and may be the same or a different source. The diluent 140 also may be positioned herein. The same or a further cooling circuit 200 also may be used herein. The nozzle diluent source 220 supplies the diluent 140 to the nozzle assembly as described below.

The beverage dispensing system 100 also may include a nozzle assembly 230. The nozzle assembly 230 may mix the diluted mixture 195 with the diluent 140 and other fluids so as to form a beverage 235. The dispensing nozzle assembly 230 may be of conventional design. More specifically, the dispensing nozzle assembly 230 may be similar to those described in commonly owned U.S. Pat. No. 7,383,966 to Ziesel, entitled "Dispensing Nozzle"; U.S. Patent Publication No. 2006/0191964 to Ziesel, entitled "Dispensing Nozzle"; U.S. Patent Publication No. 2007/0205219 to Ziesel, entitled "Dispensing Nozzle Assembly"; and/or U.S. patent application Ser. No. 11/782,833 to Ziesel, entitled "Dispensing Nozzle Assembly." U.S. Pat. No. 7,383,966; U.S. Publication No. 2006/0191964; U.S. Publication No. 2007/0205219; and U.S. Ser. No. 11/782,833 are incorporated herein by reference in their entirety. Other types of nozzle assemblies may be used herein.

The beverage dispensing system 100 also may include a clean-in-place system 240. The clean-in-place system 240 may include a cleaning solution source 250 with a cleaning solution 260 therein. The cleaning solution 260 may be hot water and/or other types of cleaning and/or sanitation solutions may be used herein. The clean-in-place system 240 may be in communication with one of the first pumps 150 or otherwise. The clean-in-place system 240 may direct the cleaning solution 260 through the first pump 150, the mixing chamber 190, the cooling circuit 200, the nozzle assembly 230, and otherwise. More than one clean-in-place system 240 or circuit may be used. Other types of sanitation system also may be used.

In use, a sweetener 120 may be stored in the sweetener source 110 and pumped via one of the first pumps 150. Depending upon the nature of the sweetener 120 and the distance of the sweetener source 110 from the nozzle assembly 230, one or more of the further pumps 170 also may be used. The sweetener 120 and the diluent 140 from the diluent source 130 may be mixed in the mixing chamber 190 to form the diluted mixture 195. The diluted mixture 195 then may be chilled in the cooling circuit 200. The diluted mixture 195 then may be mixed further with the diluent 140 at the nozzle assembly 230 via the nozzle diluent source 220. The completed beverage 235 then may be served via the nozzle assembly 230. Use of the clean-in-place system 250 may be initiated on demand or on a time or a volume based schedule.

The beverage dispensing system 100 thus may position the sweetener source 110 at any distance from the nozzle assembly 230. Such positioning may allow for the use of a much larger sweetener source 110 than generally can be used in close proximity to the nozzle assembly 230. The use of such a larger sweetener source 110 thus requires less change over and may provide more room about the nozzle assembly 230 for other types of beverage components.

The sweetener 120, in this case HFCS, may be stored in the sweetener source 110 at about 65° brix or above. The HFCS should be substantially shelf stable above about 65° brix although pasteurization, clean fill techniques, or similar methods also may be used. The HFCS may be diluted down to about 60° brix or so in the mixing chamber 190 and further diluted to about 55° brix or to the desired brix in the dispensing nozzle 230 to form the beverage 195. The HFCS and other sweeteners 120 are easier to mix when diluted. The clean-in-place system 240 may be needed once the HFCS drops below about 65° brix. The sweetener 120 thus may be shelf stable in storage, diluted somewhat for transport to the nozzle assembly 230, and then further diluted at the nozzle assembly 230 for preparation of the beverage 235. The step of prediluting the sweetener 120 before the nozzle assembly 230 thus reduces the extent to which the clean-in-place system 240 must be used as compared to storing a lower brix sweetener 120 while also promoting easier pumping and mixing as compared to the use of a higher brix sweetener 120.

The beverage dispensing system 100 also may use different types of sweeteners 120 and sweetener concentrations. Higher concentrations, however, may require more pumps, more robust pumps, or earlier predilution. Concentration of up to a native 77° brix or higher may be used.

In a further example, the sweetener 120 may have a concentration of less than about 62° brix but with the addition of an acid compound and/or preservatives. The use of the acid compound and/or preservatives also may require at least two sweetener sources 110, one for regular beverages and one for low calorie beverages. Only the first pump 150 (or a pair of first pumps 150) may be needed. Likewise, the clean-in-place system 240 may not be needed given the use of the acid compound and/or preservatives. Alternatively, the sweetener 120 may have a concentration of less than 62° brix, but without the addition of the acid compound and/or preservatives. In this example, again only the first pumps 150 would be needed. The clean-in-place system 240, however, also would be needed. The diluent 140 from the diluent source 130 may not be needed given the lower brix.

Figure 2:
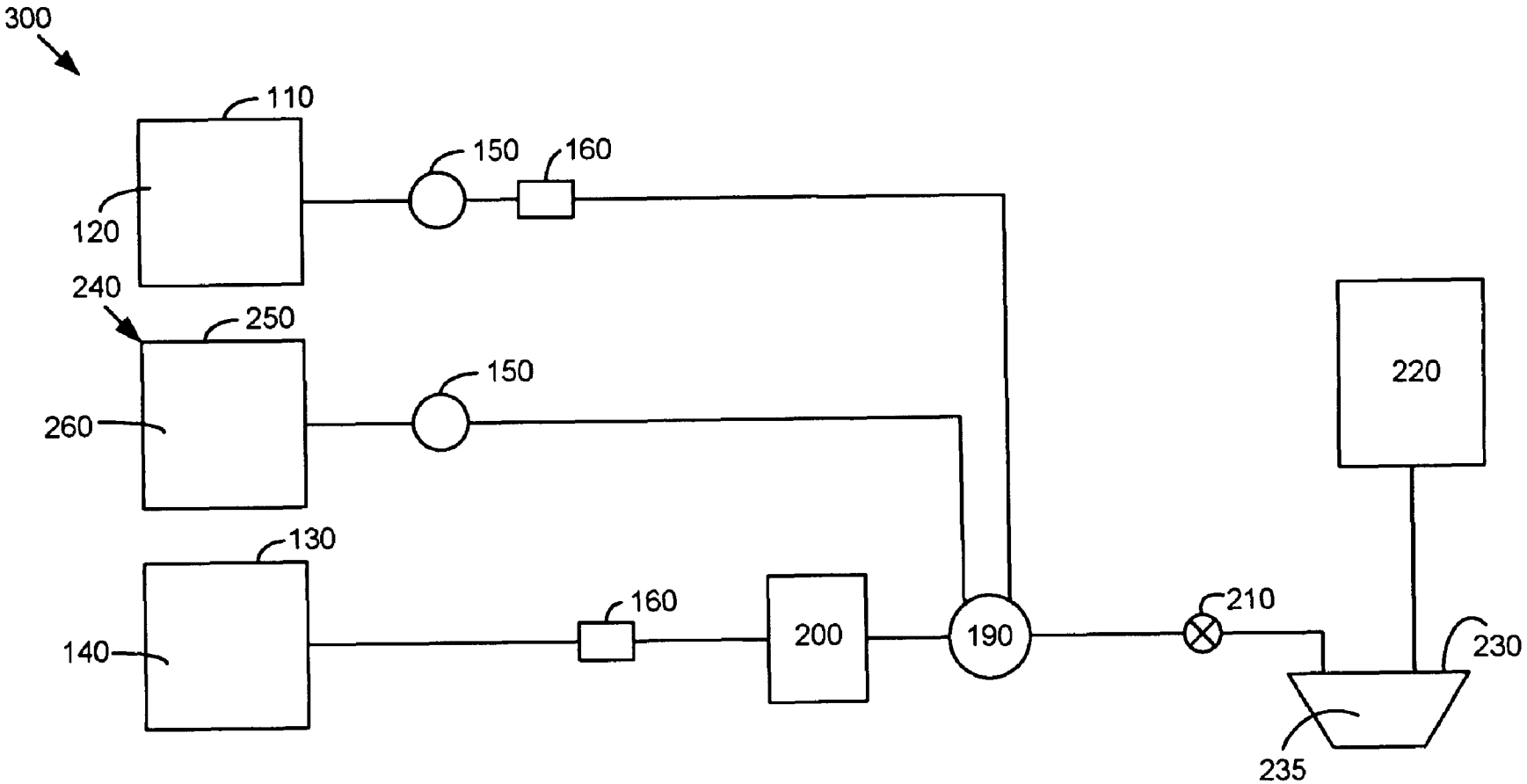
FIG. 2 is a schematic view of an alternative beverage dispensing system as is described herein.

FIG. 2 shows a further embodiment of a beverage dispensing system 300. The beverage dispensing system 300 uses similar components to the beverage dispensing system 100 described above but with different positioning of several of the components described above. In this embodiment, however, the mixing chamber 190 may be positioned downstream of the cooling circuit 200. By placing the mixing chamber 190 downstream of the cooling circuit 200, the sweetener 120 and the resulting diluted mixture 195 should be easier to pump as compared to the configuration of FIG. 1 given the use of the nonrefrigerated sweetener 120. As such, the further pumps 170 may not be needed and/or the first pump 150 may not be as robust. The mixing chamber 190 also may be positioned elsewhere. Other configurations may be used herein.

Figure 3:
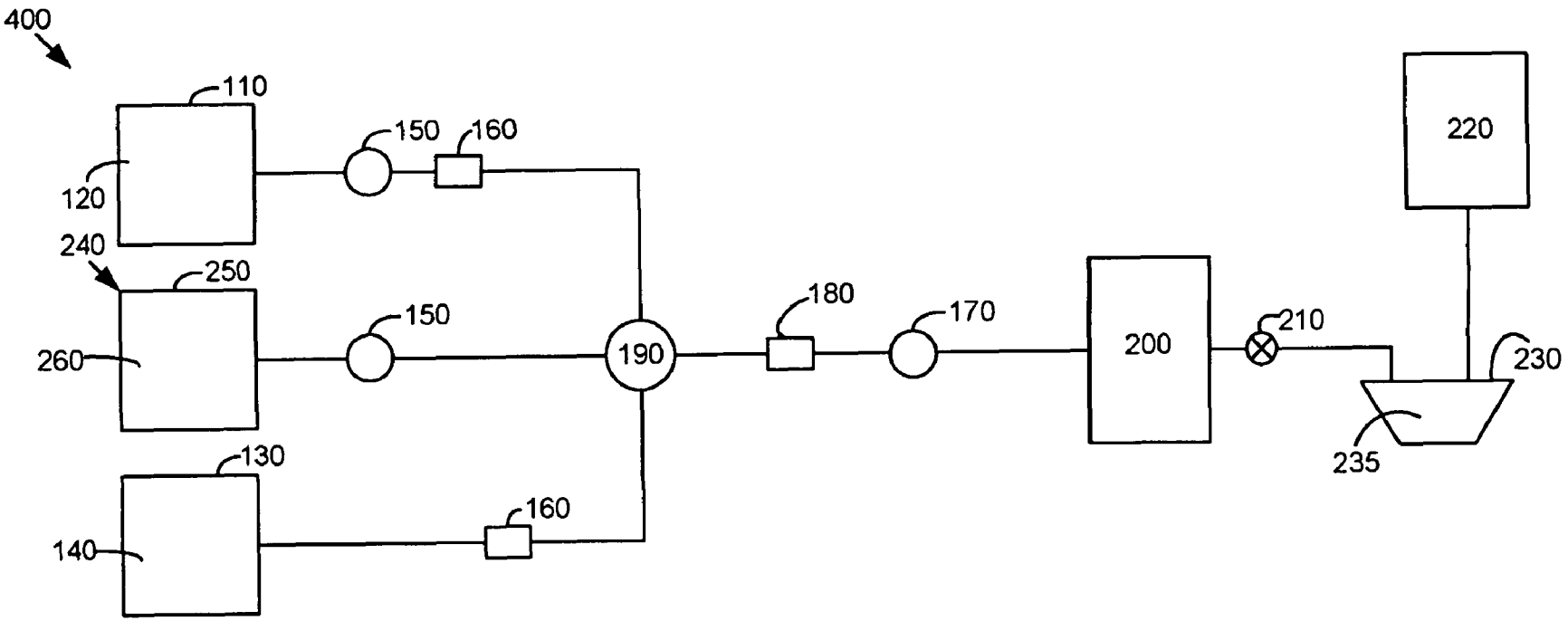
FIG. 3 is a schematic view of an alternative beverage dispensing system as is described herein.

FIG. 3 shows a further embodiment of a beverage dispensing system 400. The beverage dispensing system 400 may be similar to the beverage dispensing systems described above and may have similar components. In this example, the further pump 170 may be positioned downstream of the mixing chamber 190. More than one further pump 170 may be used. This embodiment may be well suited if the sweetener sources 120 are at a distance from the dispensing nozzle 230. Other configurations may be used herein.

Figure 4:
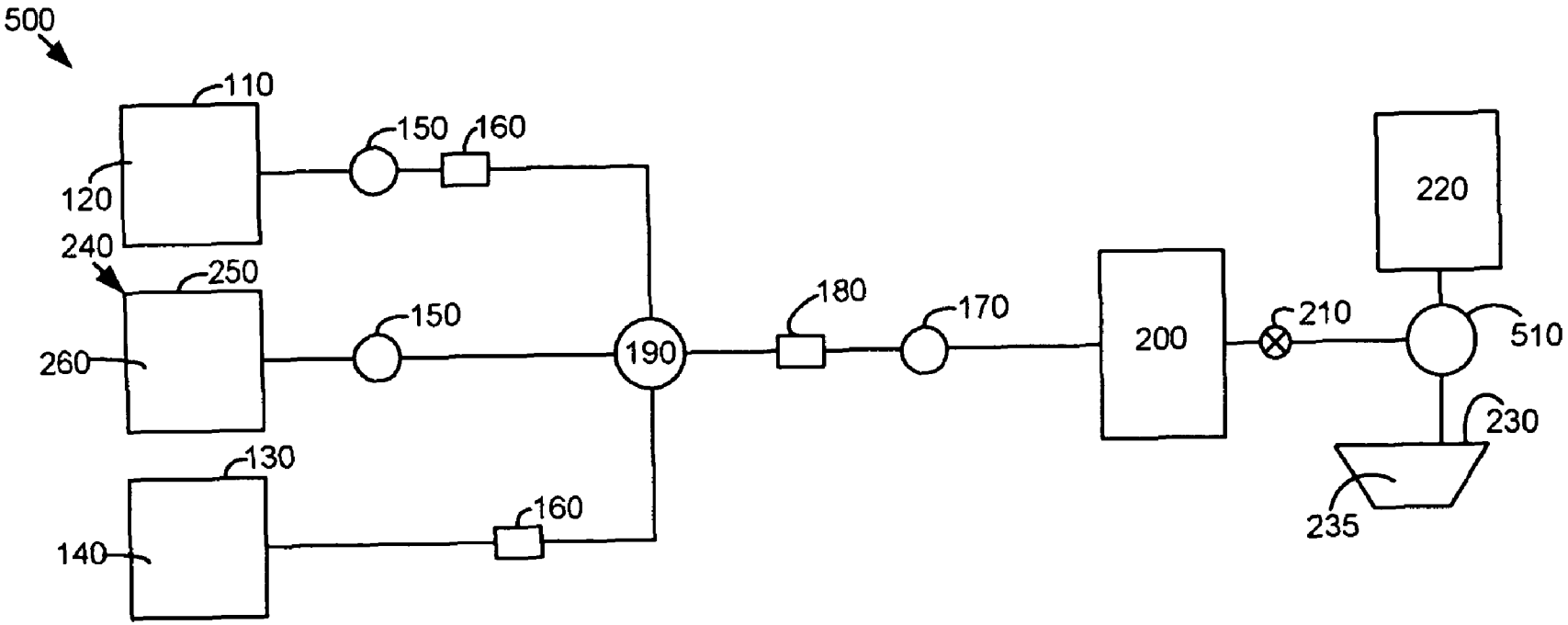
FIG. 4 is a schematic view of an alternative beverage dispensing system as is described herein.

FIG. 4 shows a further embodiment of a beverage dispensing system 500. The beverage dispensing system 500 may be similar to the beverage dispensing systems described above and may have similar components. In this example, a further mixing chamber 510 may be positioned upstream of the nozzle assembly 230. The mixing chamber 510 may be similar to the mixing chamber 190. Likewise, the mixing chamber 510 may be a T-line upstream of the nozzle assembly 230. The mixing chamber 510 may mix the diluted mixture 195 with the diluent 140 from the nozzle diluent source 220 to form the beverage 235. The beverage 235 then may be dispensed via the nozzle assembly 230. The further mixing chamber 510 also may be positioned elsewhere, including upstream of the cooling circuit 200.

In addition to the use of HFCS, sucrose (sugar) also may be used. Sucrose may have a viscosity of about double that of HFCS at about 65° brix. The sucrose thus may need to be further diluted. As such, the sucrose generally may be pasteurized with the use of an irradiated bag-in-box or other type of sweetener source 110. The use of sanitizers when connecting the sweetener source 110 also may be considered. Use of the clean-in-place system 240 generally will be required. The use of an inverted sucrose solution of about 80° brix also may be used. Such a solution likewise may need to be diluted to a pumpable or mixable form. The use of the clean-in-place system 240 generally will be required. The use of an acidified sucrose solution and/or preservatives also may be considered. Other types and combinations of sweeteners may be used herein.

It should be apparent that the foregoing relates only to the preferred embodiments of the present application and that numerous changes and modifications may be made herein by one of ordinary skill in the art without departing from the general spirit and scope of the invention as defined by the following claims and the equivalents thereof.

We claim:

1. A beverage dispensing system using a sweetener, comprising:

a dispensing nozzle;

a sweetener source with the sweetener at more than about 65° brix;

a first diluent source with a first diluent;

a mixing chamber in communication with the sweetener source and the first diluent source so as to dilute the sweetener to less than about 65° brix;

a second diluent source with a second diluent so as to dilute further the sweetener at the dispensing nozzle; and one or more first pumps in communication with the sweetener source and one or more further pumps downstream of the one or more first pumps.

2. The beverage dispensing system of claim 1, wherein the sweetener comprises high fructose corn syrup, sucrose, an acid component, a preservative, and/or a pasteurized sweetener.

3. The beverage dispensing system of claim 1, wherein the one or more first pumps comprise a metered pump or a positive displacement pump.

4. The beverage dispensing system of claim 1, wherein the one or more further pumps are positioned downstream of the mixing chamber.

5. The beverage dispensing system of claim 1, further comprising a cooling circuit.

6. The beverage dispensing system of claim 5, wherein the cooling circuit is positioned downstream of the mixing chamber.

7. The beverage dispensing system of claim 1, further comprising a clean-in-place system in communication with the mixing chamber and the dispensing nozzle.

8. A beverage dispensing system using a sweetener, comprising:

a dispensing nozzle;

a sweetener source with the sweetener at more than about 65° brix;

one or more first pumps in communication with the sweetener source;

one or more further pumps downstream of the one or more first pumps;

a first diluent source with a first diluent;

a mixing chamber in communication with the sweetener source and the first diluent source so as to dilute the sweetener to less than about 65° brix; and a second diluent source with a second diluent so as to dilute further the sweetener upstream of the dispensing nozzle;

wherein the one or more further pumps are positioned upstream of the mixing chamber.

9. The beverage dispensing system using a sweetener, comprising:

a dispensing nozzle;

a sweetener source with the sweetener at more than about 65° brix;

a first diluent source with a first diluent;

a mixing chamber in communication with the sweetener source and the first diluent source so as to dilute the sweetener to less than about 65° brix; and a second diluent source with a second diluent so as to dilute further the sweetener upstream of the dispensing nozzle; and a cooling circuit;

wherein the cooling circuit is positioned upstream of the mixing chamber. positioned upstream of the mixing chamber.

10. The beverage dispensing system using a sweetener, comprising:

a dispensing nozzle;

a sweetener source with the sweetener at more than about 65° brix;

a first diluent source with a first diluent;

a mixing chamber in communication with the sweetener source and the first diluent source so as to dilute the sweetener to less than about 65° brix; and a second diluent source with a second diluent so as to dilute further the sweetener upstream of the dispensing nozzle;

a further mixing chamber upstream of the dispensing nozzle.

11. A method of providing a sweetener to a dispensing nozzle, comprising:

storing the sweetener at a brix of about 65° or higher;

flowing the sweetener to a mixing chamber;

diluting the sweetener to a brix of less than about 65°;

flowing the sweetener to the dispensing nozzle; and further diluting the sweetener upstream of the nozzle.

12. The method of claim 11, wherein the storing step comprises storing the sweetener remote from the dispensing nozzle.

13. The method of claim 11, wherein the step of flowing the sweetener to a mixing chamber comprising pumping the sweetener with a first pump.

14. The method of claim 11, further comprising the step of chilling the sweetener.

15. The method of claim 14, wherein the step of chilling the sweetener comprises chilling the sweetener after diluting the sweetener.

16. The method of claim 11, further comprising cleaning in place the mixing chamber and the dispensing nozzle.

17. A method of providing a sweetener to a dispensing nozzle, comprising:

storing the sweetener at a brix of about 65° or higher;

flowing the sweetener to a mixing chamber;

diluting the sweetener to a brix of less than about 65°;

flowing the sweetener to the dispensing nozzle; and further diluting the sweetener upstream of the nozzle.

chilling the sweetener before diluting the sweetener.

18. A beverage dispensing system using a sweetener, comprising:

a dispensing nozzle;

a sweetener source with the sweetener at more than about 65° brix;

a first pump in communication with the sweetener source;

a first diluent source with a first diluent;

a mixing chamber in communication with the sweetener source and the first diluent source to dilute the sweetener to less than about 65° brix;

a chilling circuit to chill the sweetener, the first diluent, or both;

a second diluent source with a second diluent so as to dilute further the sweetener at the dispensing nozzle; and one or more further pumps downstream of the first pump.

* * * * *